US005152514A

United States Patent [19]

Meetze

[11] Patent Number: 5,152,514

[45] Date of Patent: Oct. 6, 1992

[54] COMPUTER FORM FEEDING WITH A UNIVERSAL DOCUMENT FEEDER

[75] Inventor: Murray O. Meetze, Rochester, N.Y.

[73] Assignee: Xerox Corporation, Stamford, Conn.

[21] Appl. No.: 808,481

[22] Filed: Dec. 16, 1991

[51] Int. Cl.[5] ..... B65H 5/00; B65H 20/02

[52] U.S. Cl. ..... 271/3.1; 271/9; 226/195; 400/613.2

[58] Field of Search ..... 271/3.1, 9; 226/195; 400/613.2, 613.3; 355/75, 76

[56] References Cited

U.S. PATENT DOCUMENTS

| | | | |
|---|---|---|---|
| 3,070,204 | 12/1962 | Bradshaw | 400/613.2 X |
| 4,054,235 | 10/1977 | Witcher | 226/200 |
| 4,226,410 | 10/1980 | McIntosh, Sr. et al. | 270/61 F |
| 4,300,710 | 11/1981 | DuBois et al. | 226/74 |
| 4,427,404 | 1/1984 | Yamada | 493/414 |
| 4,488,829 | 12/1984 | Hidaka | 400/613.2 X |
| 4,579,326 | 4/1986 | Pinckney et al. | 271/3.1 |
| 4,579,449 | 4/1986 | Leroy | 355/75 |
| 4,635,916 | 1/1987 | Modugno et al. | 271/3 |
| 4,688,957 | 8/1987 | Prevignano | 400/613.1 X |
| 4,754,960 | 7/1988 | Muller | 271/9 |
| 4,794,429 | 12/1988 | Acquaviva | 355/76 |
| 4,831,419 | 5/1989 | Iaia, Jr. et al. | 355/76 |
| 5,060,018 | 10/1991 | Watanabe | 355/230 |

OTHER PUBLICATIONS

United States Statutory Invention Registration, Registration No. H17, Published Feb. 4, 1986, "Computer Forms Web Copying Apparatus" Author: Stephen J. Wenthe, Jr.

Research Disclosure, Sep. 1991, "Computer Form Feeder", p. 663, disclosed anonymously.

*Primary Examiner*—Richard A. Schacher

[57] ABSTRACT

In a universal document feeder with which either conventional cut sheet documents or computer form (CF) web fan-folded documents may be fed to an imaging station, with an upper document loading tray with an associated feeder, but also having a separate side feeding entrance for feeding computer form web to the imaging station, there is provided a CF guide such as a bail pivotally mounted to the document feeder with a web guide surface positionable substantially above the upper document loading tray and adjacent the side of the document feeder having the side feeder entrance. This forms guide provides a path thereover for unfolding and upwardly feeding out CF which is fan-fold stacked in the upper document tray, and then downwardly in a path to the side entrance feeder, defining a web slack loop. The forms guide is spring mounted to pivot in response to variations in web forces, to ensure that the web is pulled gently and unfolds without tearing as, and after, it is pulled by the side entrance feeder, thus enabling the same (RDH) tray to be used for inputting CF as is already provided for normal documents, rather than a separate tray. A latch may be provided for latching the forms guide down in an inoperative storage position substantially flush with the top of the document feeder. The entire bail member is preferably outside of the area of this tray at all times, to provide unobstructed access thereto.

9 Claims, 3 Drawing Sheets

COMPUTER FORM FEEDING WITH A UNIVERSAL DOCUMENT FEEDER

Figure 1:
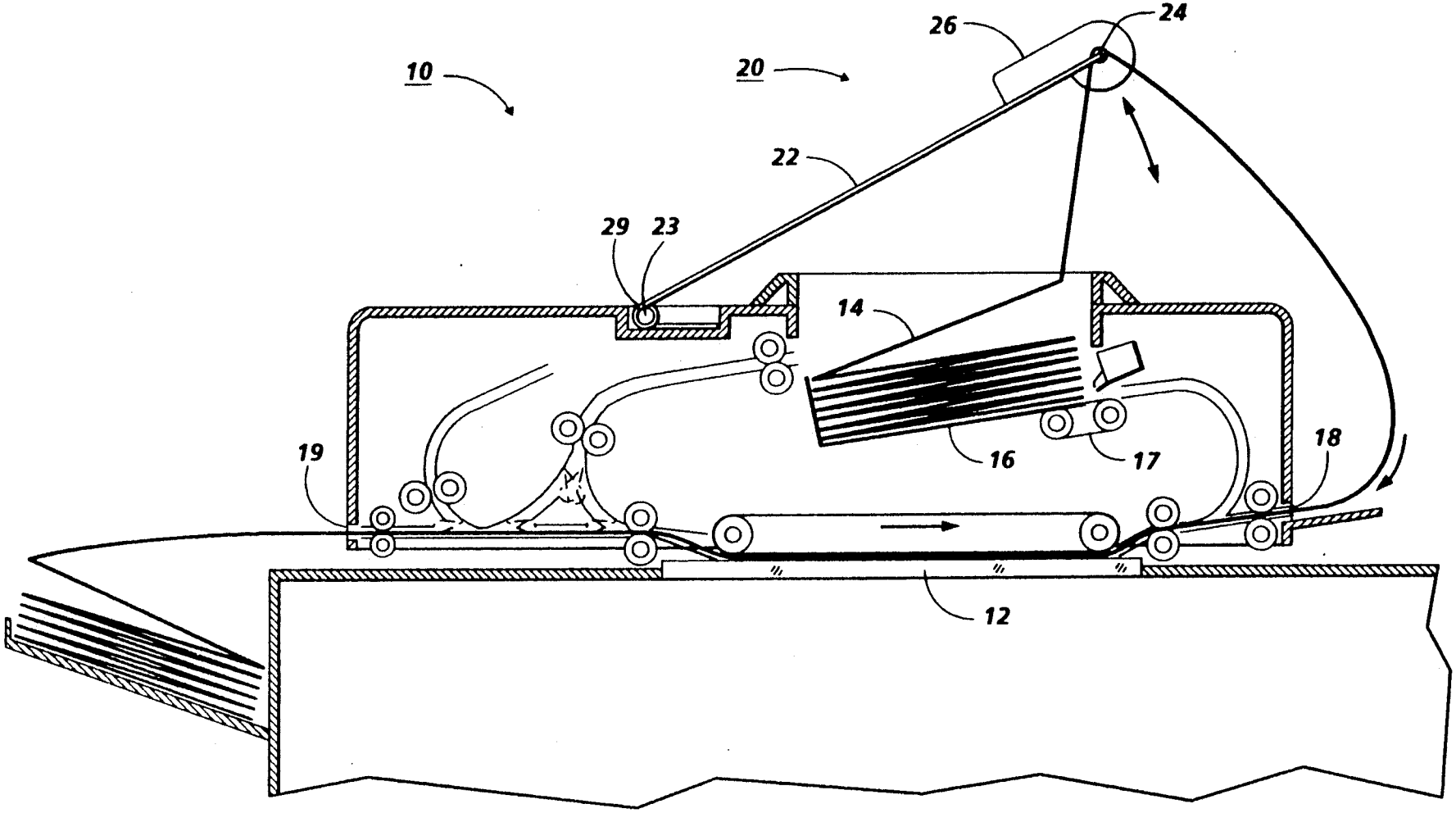

Cross-reference is made to a commonly assigned, allowed application Ser. No. 07/645,862, filed Jan. 25, 1991 by August Hoyer, et al. entitled "CUT SHEET AND COMPUTER FORM DOCUMENT OUTPUT TRAY UNIT", with a pivotally repositionable computer form web (CF) path baffle guide into a dual mode restacking tray unit for collecting either sheet documents or computer form (CF) (fan-folded web) documents in the same tray unit in two different desired sheet guiding and restacking positions.

There is disclosed herein a simple, lost cost, but effective improvement in original document handling for copiers, in particular, for improved computer form (fan-fold web) document feeding by enabling the effective use of the existing recirculating document handler (RDH) document input stacking tray and the existing semiautomatic document handling (SADH) side feeding document input of a typical modern universal type (RDH/SADH) document feeder or handler which is capable of feeding either ordinary or CF documents to the imaging station of a copier, printer or electronic imaging scanner.

Such universal type document handlers with platen transports capable of feeding either ordinary cut sheet or computer form (CF) web documents across the platen of the imaging station of a copier or printer are known and desirable. That is, a dual mode type of automatic document feeder capable of automatically feeding either conventional cut sheet type documents or CF web to and from the imaging station. Some examples of such universal document feeders with which the present invention may be used or incorporated are shown in Xerox Corporation U.S. Pat. No. 4,794,429, issued Dec. 27, 1988 to T. Acquaviva, U.S. Pat. No. 4,831,419 or U.S. Pat. No. 4,579,326, and other art cited therein, but the present system is not limited thereto.

By way of background, in xerographic and other copiers or printers, or document scanners, or other document imaging systems, it is desirable to automatically feed either normal individual sheet documents, (otherwise called "cut sheet" documents), or a continuous computer form web document (normally stacked "fan-folded") across the platen of the imaging station for imaging. This is preferably done with a document feeder or document handler (the terms are often used interchangeably in the art). After either type of document has been imaged, it is desirably automatically restacked in a restacking catch tray. Heretofore, typically the tray suitable for feeding individual cut sheet documents was not suitable or reliable for feeding fan-folded computer form web documents. [The terms copier and document handler as used herein are intended to include electronic document readers or scanners and their document feeders as well as conventional xerographic and other copiers or printers.]

Typically, two separate document input trays, and special paths, have been required for document stacking and feeding for CF, versus ordinary documents, to be fed to the platen or other imaging station by an automatic document feeder.

Some document feeders have sensors for automatically determining machine-needed information about the length and/or width of cut sheets being fed, such as a position sensor or sensors sensing the position of the adjustable stacking side guide in the RDH tray when that edge guide is reset against one edge of the particular document stack loaded therein. However, when computer forms are stacked in another location, such size sensors in the document feeder tray can not be used for sensing the dimensions of the computers forms. Therefore, this information must be manually keyed into the machine control panel. The present system allows using such document size sensing ability of a universal document feeder, where available, to automatically measure the size of CF as well as ordinary documents, thereby at least partially eliminating the need for the user to manually enter information about the size of the CF documents to be imaged.

The present system provides a simple, low cost, plural mode, truly universal document feeder which is capable of being reconfigured simply and easily by the operator into two different operating configurations or positions, for CF or ordinary documents, with both types of documents desirably being fed from the same convenient document tray.

It is important to note that in both configurations, the disclosed system allows stacking of all documents at the top of the machine, easily accessible by the operator, close to the controls, and close to the imaging statin at which the documents are being imaged, i.e., above the platen.

As disclosed herein, the conversion of the exemplary document handler between its two modes of operation can be accomplished by simple motion utilizing a simple pivoting mechanism.

In the disclosed universal document feeder embodiment, in one mode, conventional individual documents can be normally stacked in a common tray area and normally fed from that tray's feeder. In another mode, the same document feeder is easily reconfigured (by raising a simple spring loaded bail web lifting and slack loop control means, positioned for feeding computer fan-fold web), so that the same common tray area may be used for stacking and feeding out a CF fan-folded document web. But, as also shown, the CF web is not fed to the normal feeding input for that tray, it is fed to the other, SADH feeding input, desired for CF feeding. Other disclosed features and advantages are further shown or described hereinbelow with reference to this specific embodiment.

To describe the disclosed embodiment example in other words, there is disclosed a universal document feeder with a pivotable CF guide unit which does not interfere with normal cut sheet throughput but which has an operational position for computer fan fold (CFF) web throughput which allows the CFF web to be stacked directly into the normal cut sheet loading area of the universal document feeder and fed therefrom, not into that feeder but rather into its normal separate CF feeding side entrance. The CF guide unit may be easily reconfigured in a simple pivoting motion by the operator simply releasing it. The disclosed CF web guide accessory may desirably lay flat and out of the way for normal cut sheet feeding, but automatically is held up at a preset desired resilient range of angles thereabove for CF feeding.

Also disclosed herein in the specific disclosed embodiment example is in a document feeding apparatus with which either conventional cut sheet documents or computer from web fan-folded documents may be fed to an imaging station, said feeding apparatus having an upper document loading tray with associated feeder and also having a separate side feeding entrance feeder at one side of said document feeding apparatus usable for feeding computer form web to the imaging station by pulling computer form web therein, the improvement comprising: forms guiding means pivotally mounted to said document feeding apparatus; said forms guiding means having an operative computer form web guide surface portion positionable substantially above said upper document loading tray and adjacent the side of said document feeding apparatus having said separate side entrance feeder; said forms guiding means including spring means to provide resilient pivotal movement of said operative web guide surface portion in response to variations in computer form web forces thereon; said web guide surface portion providing a path thereover for unfolding and upwardly feeding computer form web fan-fold stacked in said upper document loading tray upwardly out of said tray, and then downwardly in a path to said separate side entrance feeder, defining a web slack loop; said forms guiding means being resiliently pivotable with said spring means to provide computer form web shock absorbing and ensure that computer form web is pulled gently and unfolds without tearing as it is pulled by said separate side entrance feeder.

Additional disclosed features of the specific embodiment include those wherein said forms guiding means is a bail member pivotally mounted to the top of said document feeding apparatus adjacent one end thereof; and/or wherein said forms guiding means resiliently pivots against the spring force of said spring means such that at least a portion of said web slack loop feeds into said separate side entrance feeder when said computer form web fan-fold stacked in said upper document loading tray offers resistance to said pull of said separate side entrance feeder; and/or wherein said forms guiding means pivots up by the spring force of said spring means to replenish the length of said web slack loop by gently unfolding and upwardly feeding said computer form web fan-fold stacked in said upper document loading tray during periods of time between pullings of said separate side entrance feeder; and/or wherein said forms guiding means is a bail member pivotally mounted to the top of said document feeding apparatus adjacent the side thereof, opposite from said separate side entrance feeder; and/or further including latching means for latching said forms guiding means down in an inoperative storage position substantially flush with the top of said document feeding apparatus when not in use; and/or wherein said bail member is outside of said upper document loading tray to provide unobstructed access thereto; and/or wherein said upper document loading tray is the loading and restacking tray of a recirculating document handler.

Of particular art interest, although not admitted to be U.S. prior art, or operative, is a "Research Disclosure" publication "September 1991"page 663 (disclosed anonymously) entitled "Computer Form Feeder" showing CF web being fed from an insert tray 30 in the RDH tray of a recirculating document feeder to an apparently SADH input location thereof with some sort of an added assist roller 32 placed therein and somehow maintained driven against the top of the CF stack (how is not disclosed).

Other art of interest on computer form (CF) fan-folded web document feeding and restacking trays includes: Xerox Corporation U.S. Pat. No. 4,754,960, issued Jul.5, 1988 to G. A. Muller; and Xerox Corporation U.S. Statutory Invention Registration SIR H17, by Stephen J. Wenthe, Jr., published Feb. 4, 1986, and various other art noted therein including R.C. Du Bois U.S. Pat. No. 4,300,710; and EK U.S. Pat. No. 4,579,449, issued Apr. 1, 1986 to R. D. Leroy; and IBM L. D. Witcher U.S. Pat. No. 4,054,235, issued Oct. 18, 1977; and R. McIntosh et al. U.S. Pat. No. 4,226,410 and J. Watanable U.S. Pat. No. 5,060,018.

As disclosed in this fan-fold CF document feeding art, such as in said SIR H17, or U.S. Pat. No. 4,300,710, or U.S. Pat. No. 4,579,449, it is known to provide a vertically upstanding wall or bail over which the CF web is initially fed between its stacking position and the input feeder which is pivotally raised from a horizontal position to a fixed vertical operating position.

Of particular interest here, U.S. Pat. No. 4,635,916, issued Jan. 13, 1987, to J.J. Modugno, et al., (Xerox Corporation), discloses a dual mode document feeder and computer form web restacker, wherein CF web output is restacked, after imaging, in the normal document feeding input tray of an RDH.

Additional background art, regarding examples of a dual mode (CF or normal documents) restacking tray are shown in the above cross-reference application, or U.S. Pat. No. 4,982,945, issued Jan. 8, 1991, to Xerox Corporation, by J. Marasco and M. Sugiyma, or European patent application A1 0 347 973, published Dec. 27, 1989, by Anne Willem (Oce'-Netherland, B.V.), and Oce-Nederland B.V. U.S. Pat. No. 4,993,701 to Willem A. Tosserams. Other types of CF restacking systems are shown in the above-cited patents and U.S. Pat. No. 4,427,404. Also, U.S. Pat. No. 4,191,467, issued Mar. 4,1980, R. A. Schieck (Xerox Corporation) and U.K. patent application G. B. 2,176,770A, published Jan. 7, 1987, by Ian G. Kershaw (Xerox Corporation).

All references cited in this specification, and their references, are incorporated by reference herein where appropriate for appropriate teachings of additional or alternative details, features, and/or technical background.

Figure 2:
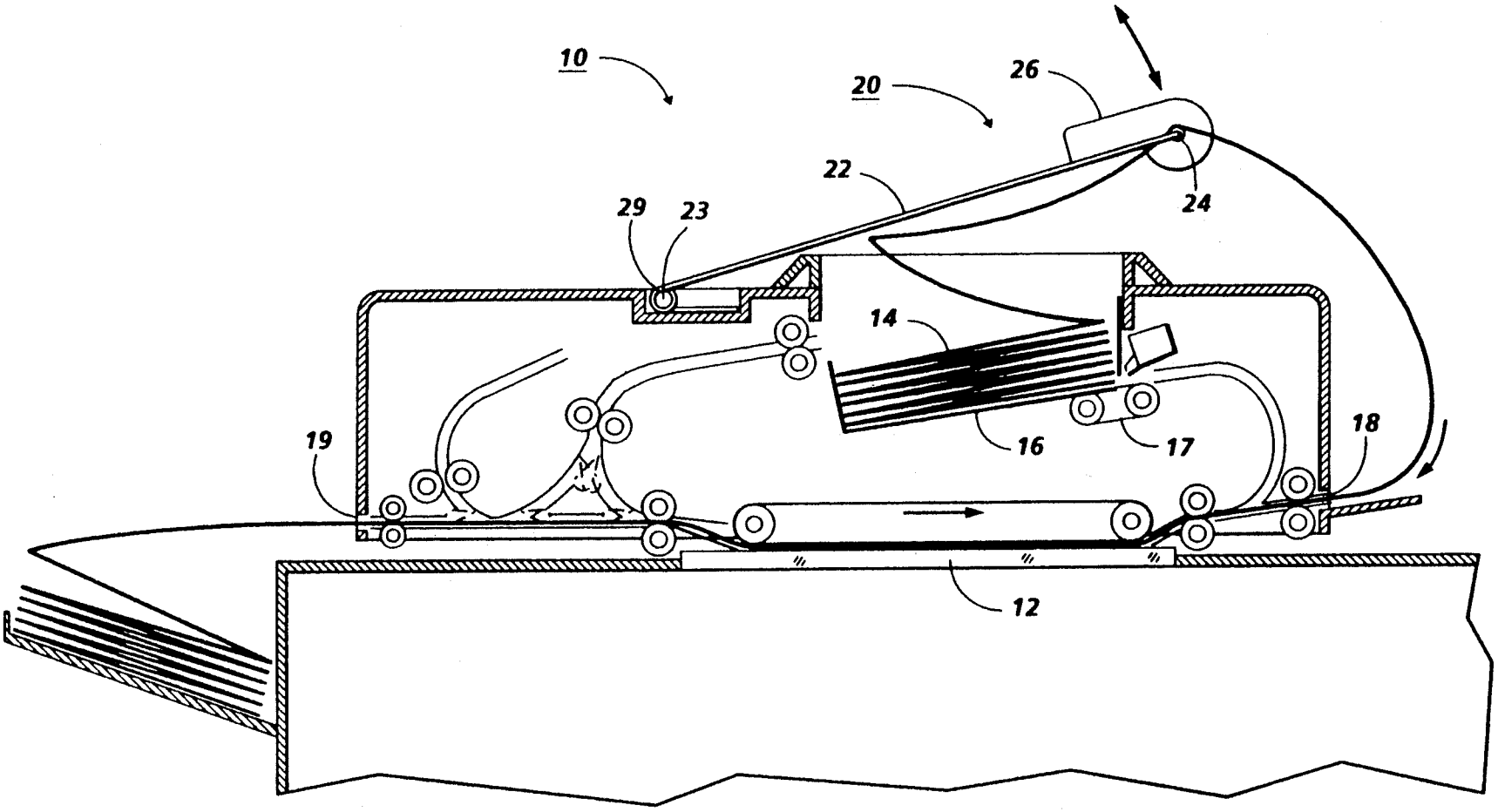
Figure 3:
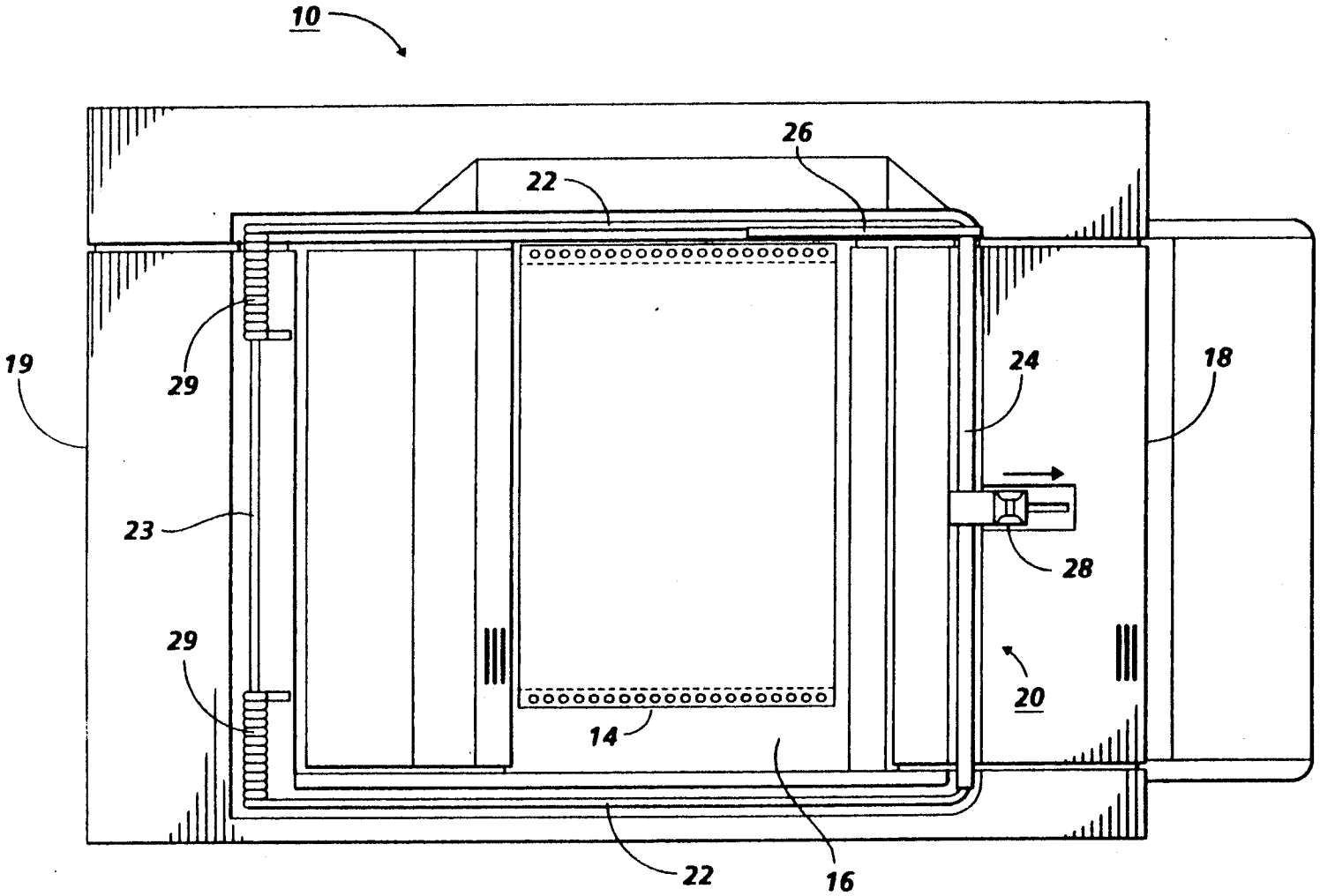

Various of the above mentioned and further features and advantages of the invention will be apparent from the apparatus and its operation described in the specific example below. Thus, the present invention will be better understood from the following description of this exemplary embodiment thereof, including the drawing figures (approximately to scale) wherein:

FIG. 1 is a schematic front side view of one embodiment of the present universal document feeding system, with the CF feeding accessory unit in its up or CF feeding position, shown integrally mounted to one example of an exemplary dual mode automatic document feeder, as cited above, and showing in a side view a CFF web form being fed according to the teachings of the invention;

FIG. 2 is the same as FIG. 1, but showing a different operating position of the movable bail CF feeding accessory unit during CF web feeding, to show how this forms guiding means and the form can respond to feeding advancement of the form into the SADH or side document feeder; and FIG. 3 is a top view of the embodiment of FIG. 1, with the CF feeding accessory unit shown in its latched down position (the inoperative or alternative cut sheet document feeding mode position).

Describing now in further detail, with reference to these Figures, there is shown an exemplary universal document feeding system embodiment 10 and its integral CF feeding accessory unit embodiment 20. There is schematically shown here one example of a commercial RDH/SADH document feeder or handler 10 for selectably feeding and copying either regular cut sheet documents or CF web, as in the above-cited patents, and various products, and thus not requiring any detailed explanation here. The document handler 10 (and its associated copier or scanner input, not needed to be shown here other than for conventional imaging platen 12) is preferably controlled by a generally conventional programmable controller, as disclosed in, e.g., U.S. Pat. No. 4,475,156 and art cited therein, preferably including a known operator input control and display screen, also not needed to be shown here.

The document handler 10 here is a known dual mode or RDH/SADH document handler comprising a recirculating document handler (RDH) also having an alternative partially shared linear semiautomatic document handler (SADH) path, as is well known and described in the cited patents. In the SADH path, it is desirable to maintain a relatively planar path for the document, for platen feeding reliability of large, damaged, or sensitive and/or stiff (thick) documents, and for CF web.

The document feeder or handler 10 here is of the above-cited type into which either regular cut sheet documents or CF web such as 14 here may be fed onto the platen 12 in a known manner from an SADH input feeding slot 18 (rather than by the RDH tray 16 feeder 17). The CF documents are fed over the platen for imaging and then on to an SADH output 19. That is, after imaging those documents on the imaging station (platen 12) under the document handler 10, they are ejected at 19 and stacked in the copy sheet exit catch tray area. A CF or dual mode restacking tray may be provided for the SADH output 19, as described in various of the above-cited references thereon. Or, as is typically done, the computer form web (CF) documents may cascade over the machine edge down into a CF restacking tray near the floor at the end or side of the machine for re-fan-folding, as also shown in some of the cited art. [However, normal cut sheet documents loaded into RDH tray 16 are fed to the platen via RDH feeder 17 and then returned (recirculated) back to the RDH tray 16, as taught in the RDH art.]

As discussed in the above-cited patents, fan-fold CF web is difficult to initially feed, as well as restack, because it must first be unfolded, along the "burst lines" between web segments where folding and unfolding must occur, and thus CF web also has variable feeding resistance force. A particular problem is that the CF web must be unfolded and fed without ever exceeding a feeding force which would cause the web to tear or burst at a "burst line". These "burst lines" are often partially precut or perforated to assist in their tearing when tearing is later desired, and therefore weakened. As disclosed in above-cited art, it is known to provide a fixed, vertically upstanding wall or bail over which the CF web is initially fed between its stacking position and the input feeder.

However, here, neither the CF web loading, or the CF web feeding, into the universal document handler 10 are in a known manner. Here, both types of documents can be loaded (stacked) for feeding and imaging into the same tray, the normal RDH document input and RDH restacking tray 16. No separate CF tray or loading position is required. That is in contrast to the CF feeding of the above-noted document handlers in which CF web is fed from a separate CF tray, spaced from one side of the document handler into the SADH feed slot 18.

The integral CF feeding accessory unit embodiment 20 here is a CF form guiding means, easily retrofitted and/or provided as a low cost accessory or included component to otherwise conventional existing universal document handlers, such as document handler 10. It does not interfere in any way with the otherwise normal operation of the document handler 10. It enables and assists better CF feeding, without requiring a separate CF feeding tray or feeder path or feeding entrance. Especially, for known document handlers with an RDH tray 16 already large enough to accommodate larger documents, such as for Japanese paper sizes, so that even the larger CF form sizes can be placed directly therein. It can also reduce and improve jam clearance.

In this example 20, the CF feeding accessory unit comprises a large pivotally spring loaded bail member 22. The bail 22 may be, as here, a simple wire form square or "U". Here it is pivotally connected at one end 23 to the document handler 10, preferably at a position on or slightly recessed into the upper surface of the document handler 10, preferably at the side thereof opposite that from which the CF web is to be fed. Here, that is also opposite from the SADH document feeding entrance, the SADH input slot 18. This embodiment (with the bail 22 hinged to the left of the tray 16 and a CF stack therein) is believed to have some benefits in unfolding the web segments more gently and reliably from the stack. However, a slightly different embodiment (with a smaller bail which is instead hinged to the right of the stack near the right top end of the document handler 10) was successfully reduced to practice. The other or operative end 24 of the bail member 22, i.e., a transverse bar or rod portion 24, over which the CF web rides and is guided by, is over the other end of the document handler 10.

This forms guiding means provided by bail 22 is preferably made of a sufficiently rigid but lightweight material such as plastic or aluminum, so as to offer low inertia, which allows it to move quickly to serve a shock absorbing function in response to the sudden pulls of the document feeder, as will be described. If desired, the guide bar portion 24 could also be covered with a Teflon or Nylon tube or tape for lower web friction. Although a unitary bail 22 is shown, another embodiment of the invention could incorporate a forms guiding means which is composed of a plurality of elements, at least one of which elements is movable to provide the dynamic characteristics required.

The bail 22, when not in use, as shown in FIG. 3, stores flush with, or slightly recessed into grooves in, the top of the document handler 10, held down by any suitable latch 28. As shown in FIG. 3, the bail 22 here surrounds, and is entirely outside of, the tray 16, so as never to obstruct the tray 16 access. The movable design of the forms guiding means 22 allows it to be conveniently stored out of the way when the UDH 10 is being used for "cut sheets" (documents other than computer fan-fold forms).

When the bail 22 is unlatched 28 from this inoperative or latched down position, it automatically pivots up into the operating position shown in FIGS. 1 or 2. This is due to a suitable, simple connecting spring 29, such as the illustrated coil or "mousetrap" spring connecting to the pivotal mounting end 23.

In the initial CF loading, the lead end of the CF form to be fed is pulled out of tray 16 and draped over (around) the raised end 24 of the movable bail 22 to form a length of slack in the form, and then enters the SADH entrance slot 18.

In CF feeding operation, the forms guiding means 22 provides an initial path for the forms which is sufficiently upward from the stack of forms to ensure that if they are pulled gently then they will unfold without tearing. The pivotal attachment of the forms guiding means 22 to the UDH 10 allows it to pivot both downward and forward aginst the spring return 29 such that a length of web slack feeds into the SADH 18 when the folded forms in tray 16 offer resistance to the pull of the SADH 18. That is, the cantilevered operative end 24 of the bail 22 moves (deflects) in response to the pull of the side document feeder 18 on the CF web portion downstream of bail guide 24. This action serves a shock absorbing function which protects the upstream unfolding forms segments from the sudden pull of the SADH 18. The spring return means 29 then replenishes the length of web slack by gently unfolding the forms, in particular, continuing to do so during the period of time between pulls of the SADH 18, i.e., lifting and unfolding subsequent web segments in the time periods of the web segment copying pauses, between segment feeding.

As noted, without an appropriate CF web feeding path and length of slack and shock absorption of the sequential CF web acceleration needed for sequential feeding, stopping, feeding, etc. for each copied web segment, CF forms, will usually tear on a perforation or miss-feed. It was found that without the device 20, proper dynamics of the CF forms unfolding would not be achieved from feeding from the RDH tray, due to the web feeding acceleration of the document feeder (especially when the fold is on the end near the SADH document feeder entrance). The present system also provides forms guiding means with dynamic characteristics which assist the proper unfolding of the forms as they are fed up out from the top document tray to then go around to the side or SADH feeder. It provides said dynamic characteristics such that said forms are protected from the stressful pulling forces of the document handler feeder during critical times of vulnerability during said unfolding. Yet the present system provides said forms guidng means at low cost, taking maximum advantage of the architecture of the current document handler.

With the present system, many of the operator problems in dealing with copying computer forms may be eliminated by the CF being loaded into the top document feeder (TDF) tray 16 of the RDH, rather than being placed in a separate location over on the top of the copier or its finisher. Using the TDF tray 16, with its existing document loading and/or size sensing, allows selecting computer forms copying to be more like selecting a normal copying feature, rather than requiring operator selections from a separate "programming world" of features options and special instructions, confusing to operators. For example, this can eliminate a requirement for the operator to determine and program the size of the originals, by using the sensors already incorporated in the universal document handler (UDH). (This requirement is now necessary in order to register successive forms and/or to set the processor pitch). Also, to eliminate the requirement that operators program appropriate reduction or enlargement settings based on personally determining the size of the CF web sebment originals. (At present, automatic reduction or enlargement settings are often not offered for computer forms.) And, as noted, eliminating the confusion related to displayed instructions to place CF originals (only) in a different input loading position (one which is normally associated with copies or output), while all other originals are placed on the other (RDH) end of the machine. That is, the instructional and job programming requirements for copying computer forms can be greatly simplified with the stack of CF forms being loaded into the top tray of the universal document handler itself, and automatically fed around to the SADH or side entrance platen level document feeder of the universal document handler.

A small vertical wall or pin side guide member 26 may be provided as shown at one side of the end 24 of the bail member 22 to assist in maintaining lateral registration of the CF web as it is being fed. However, that is not essential. That is, a side guide such as 26 at the registration edge of the bail (the rear edge in this particular example) may have benefits, and adds little cost, but may not be necessary in some embodiments. It has also been found that if the angle of the guide bar 24 of the bail member 22 can be adjusted, such as by adjusting the mounting end 23 position slightly, that this can also provide lateral web tracking adjustment, to prevent forms from creeping beyond the registration edge (toward the back of the copier). That is, to tweak the horizontal alignment of the surface 24 over which the forms are looped here. The later provides the necessary conditions for keeping the CF forms in line.

An additional feature which can be provided, but is preferably not required, is a small inserted gate or blocking member to block the top or RDH feeder 17 entrance when CF form is loaded into that RDH tray 16, to prevent any possibility of the CF form tending to "submarine" into that feeder opening when the forms are unfolding from the opposite end of tray 16. However, that only tends to occur where there is a large horizontal forward component to the CF web pulling forces. That can be avoided by CF feeding operating positon geometries of the forms guiding device 20. With the bar-like member 24 of the guide 22 located over (above) the TDF RDH tray 16 (as illustrated) the horizontal forces which could result in such a submarining action are greatly diminished.

By way of background, standard CF webs come in "segments" or "tears" between the fan-fold lines (also called "creases" or "burst lines"), with the following numbers of standard sprocket holes per CF web segment: 10, 11, 12, 14, 16, 17, 18, 20, 22, and 24. That equates to these corresponding web segment lengths (in inches):5, 5½, 6, 7, 8, 8½, 9, 10, 11, and 12. Thus, for example, a standard 12 hole CF web segment is only half the incremental length of a 24 hole CF web segment, and a 10 hole per segment CF web is half the length of a 20 hole per segment web. It may be seen that three standard CF web lengths are one half of or double another.

The registration position of the CF web on the platen 12 may be adjusted before or during feeding to maintain the desired web segment or fan-fold crease stopping point when the operator indicates to the controller that a certain CF web segment size is being fed. This can be accomplished through software control of the existing RDH platen drive servo drive motor in the existing document feeder 10. This preferred document feeder 10 has a servo-driven document platen tansport belt feeder and variable stopping positions for variable registration positions. This need not be further disclosed herein since it is already disclosed in issued U.S. Pat. No. 4,579,444 cited above.

While the embodiment disclosed herein is preferred, it will be appreciated from this teaching that various alternatives, modifications, variations or improvements therein may be made by those skilled in the art, which are intended to be encompassed by the following claims:

What is claimed is:

1. In a document feeding apparatus with which either conventional cut sheet documents or computer form web fan-folded documents may be fed to an imaging station, said feeding apparatus having an upper document loading tray with associated feeder and also having a separate side feeding entrance feeder at one side of said document feeding apparatus usable for feeding computer form web to the imaging station by pulling computer form web therein, the improvement comprising:

forms guiding means pivotally mounted to said document feeding apparatus;

said forms guiding means having an operative computer form web guide surface portion positionable substantially above said upper document loading tray and adjacent the side of said document feeding apparatus having said separate side entrance feeder;

said forms guiding means including spring means to provide resilient pivotal movement of said operative web guide surface portion in response to variations in computer form web forces thereon;

said web guide surface portion providing a path thereover for unfolding and upwardly feeding computer form web fan-fold stacked in said upper document loading tray upwardly out of said tray, and then downwardly in a path to said separate side entrance feeder, defining a web slack loop;

said forms guiding means being resiliently pivotable with said spring means to provide computer form web shock absorbing and ensure that computer form web is pulled gently and unfolds without tearing as it is pulled by said separate side entrance feeder.

2. The document feeding apparatus of claim 1, wherein said forms guiding means is a bail member pivotally mounted to the top of said document feeding apparatus adjacent one end thereof.

3. The document feeding apparatus of claim 1, wherein said forms guiding means resiliently pivots against the spring force of said spring means such that at least a portion of said web slack loop feeds into said separate side entrance feeder when said computer form web fan-fold stacked in said upper document loading tray offers resistance to said pull of said separate side entrance feeder.

4. The document feeding apparatus of claim 3, wherein said forms guiding means pivots up by the spring force of said spring means to replenish the length of said web slack loop by gently unfolding and upwardly feeding said computer form web fan-fold stacked in said upper document loading tray during periods of time between pullings of said separate side entrance feeder.

5. The document feeding apparatus of claim 1, wherein said forms guiding means is a bail member pivotally mounted to the top of said document feeding apparatus adjacent the side thereof, opposite from said separate side entrance feeder.

6. The document feeding apparatus of claim 1, further including latching means for latching said forms quiding means down in an inoperative storage position substantially flush with the top of said document feeding apparatus when not in use.

7. The document feeding apparatus of claim 1, wherein said forms guiding means comprises a bail member pivotally mounted to the top of said document feeding apparatus, and also includes latching means for latching said bail member down in an inoperative storage position substantially flush with the top of said document feeding apparatus when not in use, and wherein said bail member is outside of said upper document loading tray to provide unobstructed access thereto.

8. The document feeding apparatus of claim 1, wherein said upper document loading tray is the loading and restacking tray of a recirculating document handler.

9. The document feeding apparatus of claim 2, wherein said bail member is outside of said upper document loading tray to provide unobstructed access thereto.

* * * * *